US012291966B1

(12) United States Patent
Montois

(10) Patent No.: US 12,291,966 B1
(45) Date of Patent: May 6, 2025

(54) SYSTEMS AND METHODS FOR RANGING AND TRACKING WHILE DRILLING MULTIPLE GEOLOGICAL WELLS

(71) Applicant: Schlumberger Technology Corporation, Sugar Land, TX (US)

(72) Inventor: Michael Montois, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/502,111

(22) Filed: Nov. 6, 2023

(51) Int. Cl.
*E21B 7/06* (2006.01)
*E21B 47/0228* (2012.01)

(52) U.S. Cl.
CPC ..... *E21B 7/062* (2013.01); *E21B 7/064* (2013.01); *E21B 47/0228* (2020.05)

(58) Field of Classification Search
CPC ..... E21B 7/04; E21B 7/046; E21B 47/022; E21B 47/0228
See application file for complete search history.

(56) References Cited

U.S. PATENT DOCUMENTS 3,689,809 A 9/1972 McDonald
7,703,548 B2 * 4/2010 Clark ..... E21B 47/0228 175/45
7,812,610 B2 10/2010 Clark
8,063,641 B2 11/2011 Clark
8,307,915 B2 11/2012 Clark
8,462,012 B2 6/2013 Clark
8,596,382 B2 12/2013 Clark
8,684,107 B2 4/2014 Clark
8,695,730 B2 4/2014 Clark
8,749,242 B2 6/2014 Clark
8,827,005 B2 9/2014 Morley
8,912,915 B2 * 12/2014 Hay ..... E21B 47/04 340/853.1
9,010,461 B2 * 4/2015 Hay ..... E21B 47/13 340/854.3
9,046,343 B2 6/2015 Clark
10,072,490 B1 * 9/2018 Tchakarov ..... E21B 47/024
10,267,142 B2 * 4/2019 Pan ..... G01V 3/24
10,648,319 B2 * 5/2020 Tchakarov ..... G01V 3/34
10,858,929 B2 * 12/2020 Estes ..... E21B 7/04
11,098,572 B2 * 8/2021 Tchakarov ..... G06F 16/24554
12,104,480 B2 * 10/2024 Wiecek ..... E21B 49/00
(Continued)

FOREIGN PATENT DOCUMENTS

CN 114737904 A * 7/2022

*Primary Examiner* — Jennifer H Gay
(74) *Attorney, Agent, or Firm* — Jeffrey D. Frantz

(57) ABSTRACT

A system includes a first rotary steerable tool configured to control a first drilling bit to drill a first well having a first well path. The first rotary steerable tool includes a first direction and inclination component that includes a first set of sensors configured to detect a static magnetic field and a signal source configured to generate a source signal. The system also includes a second rotary steerable tool configured to control a second drilling bit to simultaneously drill a second well having a second well path that tracks the first well path. The second rotary steerable tool includes a second direction and inclination component that includes a second set of sensors configured to detect the source signal.

20 Claims, 4 Drawing Sheets

(56) References Cited

U.S. PATENT DOCUMENTS

| | | | | |
|---|---|---|---|---|
| 2008/0041626 | A1* | 2/2008 | Clark | G01V 3/26 340/854.6 |
| 2011/0018542 | A1 | 1/2011 | Clark | |
| 2011/0088890 | A1 | 4/2011 | Clark | |
| 2011/0278067 | A1 | 11/2011 | Clark | |
| 2012/0061143 | A1* | 3/2012 | Hay | E21B 47/13 340/854.3 |
| 2013/0333946 | A1* | 12/2013 | Sugiura | E21B 47/022 175/24 |
| 2014/0069721 | A1 | 3/2014 | Clark | |
| 2015/0377004 | A1* | 12/2015 | Hornblower | E21B 7/06 175/24 |
| 2017/0009566 | A1* | 1/2017 | Fan | G01S 19/13 |
| 2017/0138173 | A1* | 5/2017 | Estes | E21B 7/04 |
| 2018/0119545 | A1* | 5/2018 | Clark | E21B 47/0228 |
| 2020/0182037 | A1* | 6/2020 | Tchakarov | E21B 44/005 |
| 2020/0355065 | A1* | 11/2020 | Sankaran | E21B 47/0228 |
| 2021/0254448 | A1* | 8/2021 | Phillips | E21B 47/022 |
| 2022/0170323 | A1 | 6/2022 | Hawkinson | |
| 2023/0068217 | A1* | 3/2023 | Wiecek | E21B 44/00 |
| 2023/0079876 | A1 | 3/2023 | Hinke | |
| 2023/0088047 | A1* | 3/2023 | Schiermeier | E21B 7/067 175/61 |

* cited by examiner

SYSTEMS AND METHODS FOR RANGING AND TRACKING WHILE DRILLING MULTIPLE GEOLOGICAL WELLS

BACKGROUND

The present disclosure relates generally to ranging and tracking. More specifically, the present disclosure relates to drilling two geological wells simultaneously with the same orientation at a constant distance using ranging and tracking between the two geological wells.

This section is intended to introduce the reader to various aspects of art that may be related to various aspects of the present disclosure, which are described and/or claimed below. This discussion is believed to help provide the reader with background information to facilitate a better understanding of the various aspects of the present disclosure. Accordingly, it is understood that these statements are to be read in this light, and not as admissions of prior art.

Geothermal energy refers to the production of energy using internal heat of the Earth's crust. A production of geothermal energy includes drilling wells into the Earth's crust. The wells allow for heat extraction using various methods (e.g., heat extraction using hot water and steam). Geothermal heat may be used to heat homes and buildings. For example, hot water may be circulated through heat exchangers that may transfer the geothermal heat to the homes and buildings. Additionally, or alternatively, geothermal heat may be used to produce electricity (e.g., in geothermal power plants). For example, the electricity may be generated when the geothermal heat produces steam that spins turbines of a generator. The geothermal energy is a renewable and sustainable form of energy as it produces the electricity using natural heat from the Earth.

In certain applications, it may be desirable to drill multiple geological wells (e.g., geothermal wells) with similar but offset paths through a geological formation. Accordingly, a need exists for systems and methods for automatic ranging and tracking simultaneously drilled wells in geological formations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Certain embodiments of the present disclosure include a system that includes a first rotary steerable tool configured to control a first drilling bit to drill a first well having a first well path. The first rotary steerable tool includes a first direction and inclination component that includes a first set of sensors configured to detect a static magnetic field and a signal source configured to generate a source signal. The system also includes a second rotary steerable tool configured to control a second drilling bit to simultaneously drill a second well having a second well path that tracks the first well path. The second rotary steerable tool includes a second direction and inclination component that includes a second set of sensors configured to detect the source signal.

Certain embodiments of the present disclosure include a system that includes a second rotary steerable tool configured to control a second drilling bit to simultaneously drill a second well having a second well path that tracks a first well path of a first well being drilled by a first drilling bit controlled by a first rotary steerable tool. The first rotary steerable tool includes a first direction and inclination component including a first set of sensors configured to detect a static magnetic field and a signal source configured to generate a source signal. The second rotary steerable tool includes a second direction and inclination component including a second set of sensors configured to detect the source signal.

Certain embodiments of the present disclosure include a method that includes operating a first rotary steerable tool to control a first drilling bit to drill a first well having a first well path. The first rotary steerable tool includes a first direction and inclination component including a first set of sensors configured to detect a static magnetic field and a signal source configured to generate a source signal. The method also includes operating a second rotary steerable tool to control a second drilling bit to simultaneously drill a second well having a second well path that tracks the first well path. The second rotary steerable tool includes a second direction and inclination component including a second set of sensors configured to detect the source signal.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWING

Various aspects of this disclosure may be better understood upon reading the following detailed description and upon reference to the drawings in which.

DETAILED DESCRIPTION

Figure 1:
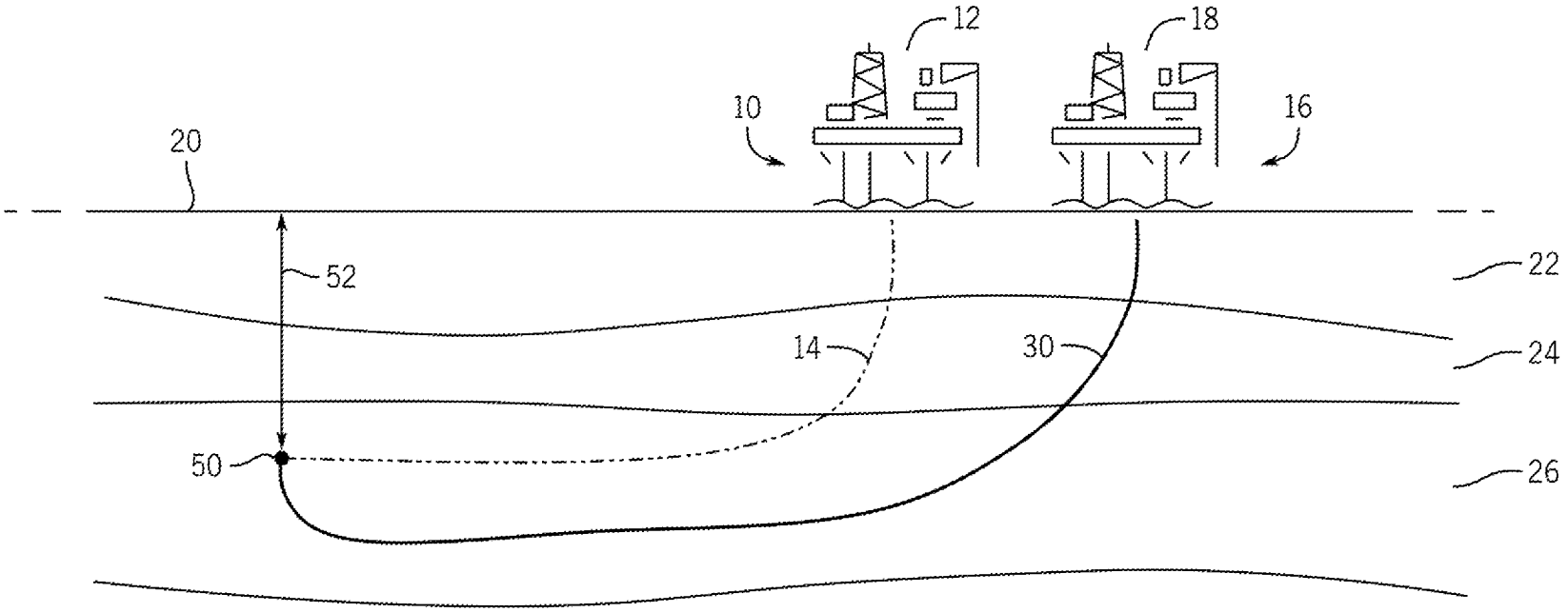
FIG. 1 is a schematic diagram of a geological survey using two wells drilled simultaneously, according to an embodiment of the present disclosure.

One Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name, but not function.

Geological wells (e.g., geothermal wells) are drilled in areas having reservoirs (e.g., medium-temperature geothermal reservoirs with temperatures ranging from 150 to 180 degree centigrade). For example, in a two-well geological survey, a primary well (e.g., an extended-reach horizontal well) may be drilled along a primary well path based on a planned well trajectory. Additionally, a secondary well (e.g., a tracker well) may be drilled simultaneously along a secondary well path parallel to the primary well path with a constant distance between the primary and the secondary well paths. During drilling operations, the primary well and secondary well may monitor and track each other until both well paths intersect at a target position (e.g., at a target depth in a reservoir).

Such simultaneous and parallel drilling operations may provide for geothermal energy harvesting with improved drilling efficiency and reduced drilling cost. In contrast, other geothermal drilling operations may include drilling a primary well in an area, and at a different time drilling a secondary well that follows a well path of the primary well. Such separate drilling operations may result in increased drilling time and additional monitoring/tracking tools to ensure the secondary well path of the secondary well drilled at the different time follows an existed primary well path of the primary well.

The simultaneous and parallel drilling operations mentioned above may rely on accurate ranging and tracking directions, orientations, and a relative distance between two drilling systems/tools used to drill the two wells during a geological survey. The present disclosure provides systems and methods for tracking relative positions between two geological wells drilled simultaneously in a real-time manner and adjusting drilling operations to maintain two well paths in the same drilling direction at a fixed distance (e.g., constant distance) with respect to each other.

For example, during a geological survey, a tracked tool including an energy source (e.g., magnetic source, seismic source, electro-magnetic source, acoustic or sound source, etc.) may be used to drill a tracked well in an area. The energy source may generate signals, such as magnetic, seismic, electro-magnetic, or other suitable signals. A tracking tool including sensors or sensor arrays may be used to drill a tracking well during the same time as the tracked well is drilled in the area. The tracking tool may detect the signals emitted from the energy source disposed in the tracked tool using the sensors or sensor arrays disposed in the tracking tool. Based on the detected signals, the tracking tool may perform a data processing, such as analyzing the detected signals, determining a direction, determining an orientation, and determining a distance with respect to the tracked tool, and so on. Using the data processing results (e.g., determined relative direction, orientation, and distance), the tracking tool may adjust (e.g., using a rotary steerable system (RSS) controlled by roll stabilized electronics) certain operations (e.g., adjusting the drilling direction), such that a well path of the tracking well follows a well path of the tracked well. In this way, the tracking tool may track the movement of the tracked tool in the real-time, resulting in two geological wells being drilled simultaneously and parallelly with a constant distance between each other.

With the preceding in mind, turning now to the figures, FIG. 1 is a schematic diagram of a geological survey using two wells drilled simultaneously in an area. A well 10 is drilled from a platform 12 (e.g., an inland or offshore platform) located in the area. The area may include a surface 20 (e.g., a surface of the ground or an ocean surface) and multiple subsurface layers, such as subsurface layers 22, 24, and 26 located at different depths with respect to the surface 20. The well 10 may be drilled vertically or substantially vertically through certain shallow subsurface layers (e.g., the subsurface layers 22 and 24). At a certain depth, for example, when approaching the subsurface layer 26 that includes a reservoir (e.g., a geothermal reservoir), the drilling direction may gradually change to a horizontal or substantially horizontal direction (e.g., approximately parallel to the surface 20), forming a well path 14 (e.g., a path of a bore hole being drilled). The well path 14 may include a substantially vertical portion and a substantially horizontal portion.

Simultaneously, a well 16 is drilled from a platform 18 (e.g., an inland or offshore platform) located in the area. The well 16 may be drilled vertically or substantially vertically through the shallow subsurface layers, such as the subsurface layers 22 and 24. When approaching the subsurface layer 26, the drilling direction may gradually change to a horizontal or substantially horizontal direction (e.g., approximately parallel to the surface 20), forming a well path 30 (e.g., a path of a bore hole being drilled). The well path 30 may include a substantially vertical portion and a substantially horizontal portion. At an intersection position 50 (e.g., at a target depth 52 in a reservoir located in the subsurface layer 26), the well path 30 intersects with the well path 14 at respective substantially horizontal portions, allowing geothermal fluids (e.g., water, steam, or other suitable fluids) to circulate and create a natural flow due to the temperature gradients and changes in fluid densities.

During simultaneous drillings of the well 10 and the well 16, certain ranging and tracking systems and tools may be used to automatically monitor and adjust drilling processes such that the well path 30 of the well 16 follows the well path 14 of the well 10. For example, a tracked tool (e.g., a bottom hole assembly (BHA1)) may be used to drill the well 10. The BHA1 may include a rotary steerable system controlled by a roll stabilizer.

The rotary steerable system provides steering and navigation to control a drilling bit to drill the well 10 based on a planned well trajectory. The steering and navigation may utilize Direction & Inclination (D&I) technology (e.g., PowerDrive), inferring the drilling direction and inclination via the Earth gravity and the Earth magnetic field. The rotary steerable system may be driven by the roll stabilizer to stabilize the BHA1 to avoid unintentional sidetracking and/or vibrations to maintain the quality of the well 10 being drilled.

The BHA1 may also include a Direction & Inclination (D&I) module. The D&I module may include certain sensors (e.g., magnetometers) to detect a direction and an inclination of the BHA1 with respect to the Earth magnetic field. Based on the detected direction and inclination, the rotary steerable system may adjust drilling operations to maintain the well path 14 to follow a planned well trajectory.

Moreover, the BHA1 may include an energy source (e.g., a permanent magnet) that may generate signals (e.g., magnetic signals). The signals may transmit through the subsurface layers and reach a tracking tool used to drill the well 16. The tracking tool may detect and analyze the signals to determine a relative position to the BHA1. Based on the relative position, the tracking tool may perform certain adjustments (e.g., changing the drilling direction, changing the tool orientation) such that the well path 30 of the well 16 may follow the well path 14 at a constant distance.

For example, the tracking tool (e.g., a bottom hole assembly (BHA2)) may include a rotary steerable system controlled by a roll stabilizer. The rotary steerable system provides steering and navigation to control a drilling bit to drill the well 16 having the well path 30 that follows the well path 14. The rotary steerable system may be driven by the roll stabilizer to stabilize the BHA2 to avoid unintentional sidetracking and/or vibrations to maintain the quality of the well 16 being drilled.

The BHA2 may also include a Direction & Inclination (D&I) module. The D&I module may include certain sensors (e.g., magnetometers) to detect the signals emitted by the energy source of the BHA1. The BHA2 may include onboard processors to analyze the detected signals. The analysis may include signal filtering, signal amplifications, amplitude calculation, orientation calculation, and so on. The BHA2 may determine a relative position (e.g., including direction, orientation, and distance) with respect to the BHA1. Based on the relative position, the rotary steerable system may adjust drilling operations to maintain the well path 30 of the well 16 to follow the well path 14 at a constant distance.

Figure 2:
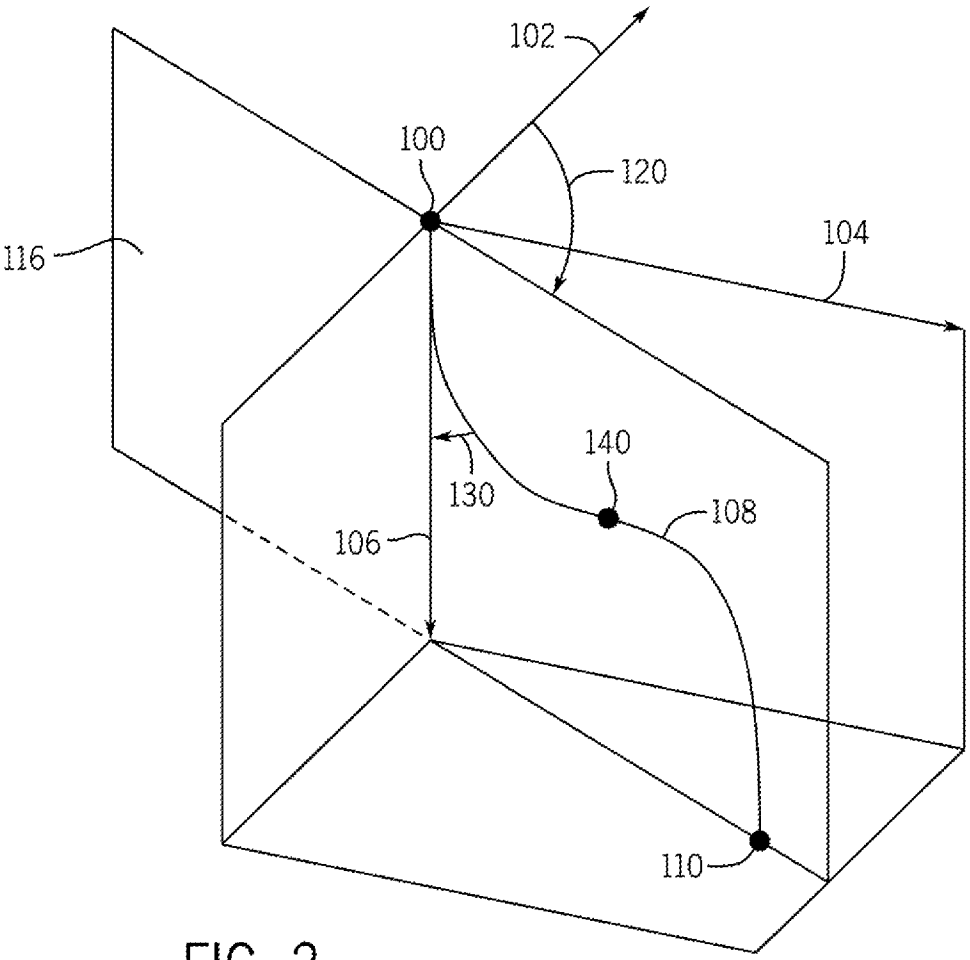
FIG. 2 is a schematic diagram of a coordinate system that may be used to determine a direction and an orientation of each of the two wells of FIG. 1, according to an embodiment of the present disclosure.
Figure 3:
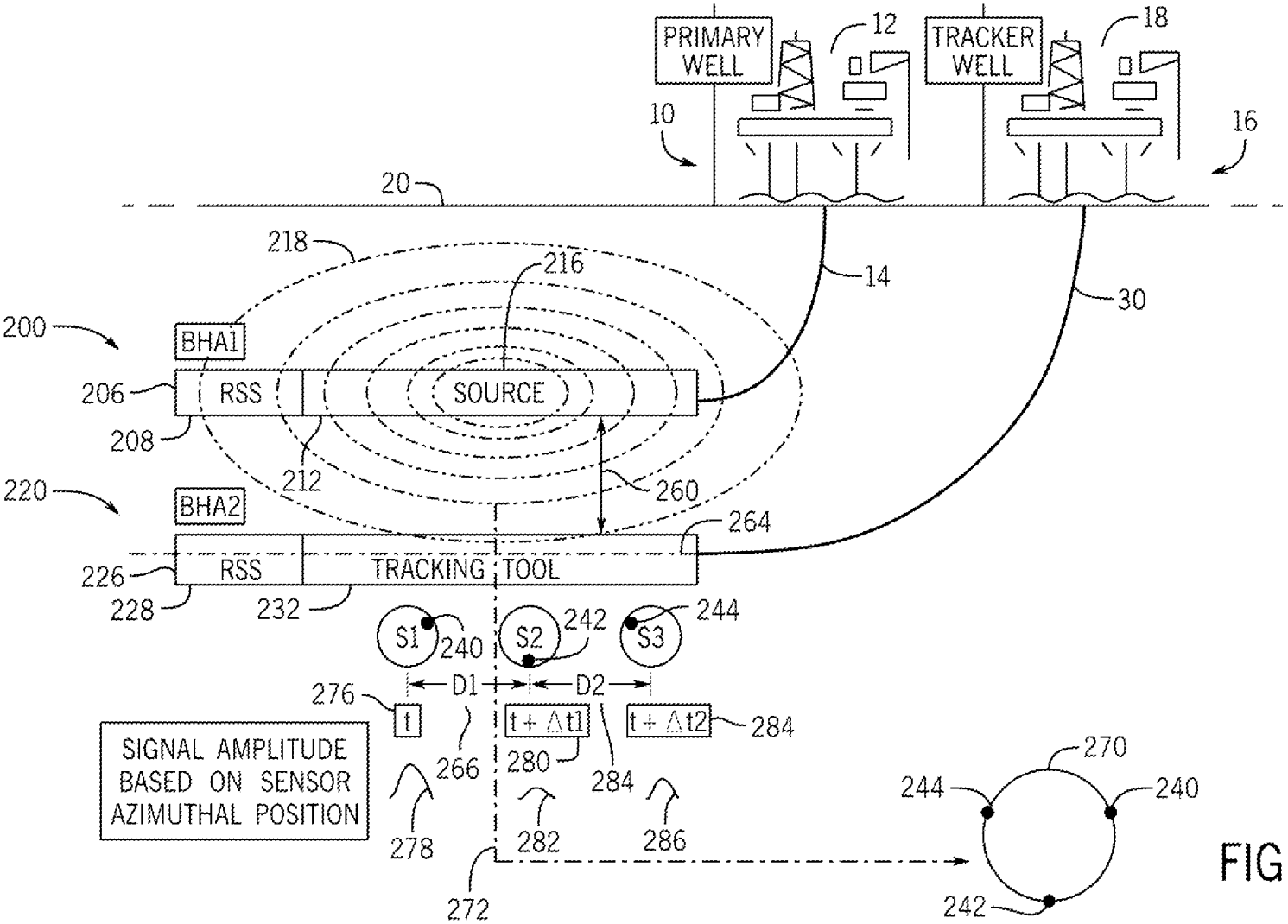
FIG. 3 is schematic diagram of a tracked tool (i.e., a tool being tracked) having source emitting signals that may be detected by sensors of a tracking tool (i.e., a tool tracking the other tool) during the geological survey of FIG. 1, according to an embodiment of the present disclosure.
Figure 4:
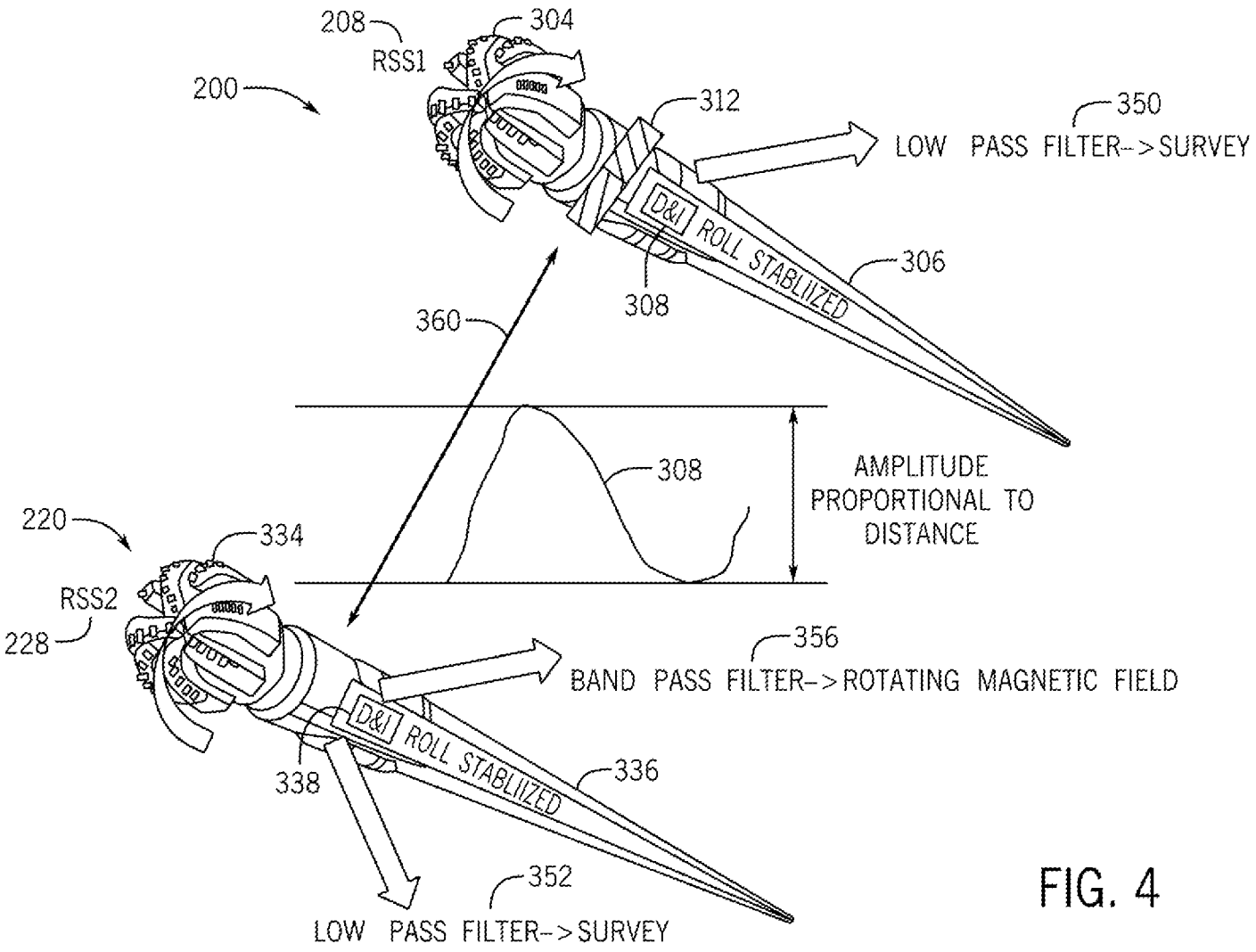
FIG. 4 is an example diagram of the tracked tool and the tracking tool of FIG. 3 having different components that may be used to determine a relative positions between the two drilling tools during the geological survey, according to an embodiment of the present disclosure.

Further details regarding automatic ranging and tracking the well 10 and the well 16 during the simultaneous drilling using the tracked tool (i.e., tool being tracked) and tracking tool (i.e., tool that tracks the other tool), including the BHA1 and BHA2 and corresponding elements (e.g., energy source, sensors), will be provided in following sections with respect to FIGS. 2-4.

FIG. 2 is a schematic diagram of a coordinate system that may be used to determine a direction and an orientation of the well 10 or the well 16 of FIG. 1. The coordinate system includes an origin 100 (e.g., a well head of the well 10 or the well 16). Three orthogonal axes, including an axis 102 (e.g., along the North direction), an axis 104 (e.g., along the East direction), and an axis 106 (e.g., along the Earth gravity direction), extend from the origin 100 to form the coordinate system.

A curve 108 starts from the origin 100, stretches downward, and ends at a position 110 (e.g., the intersection position 50 of FIG. 1), wherein the curve 108 may be used to represent a well path (e.g., the well path 14 of the well 10, or the well path 30 of the well 16 of FIG. 1). As illustrated, the curve 108 representing the well path locates in a plane 116 that includes the axis 106. The plane 116 has an azimuthal angle 120 with respect to the axis 102. The curve 108 has an inclination angle 130 with respect to the axis 106.

As mentioned above, during an operation of drilling a well (e.g., the well 10 or the well 16), a drilling tool (e.g., the tracked tool or the tracking tool mentioned above) including a bottom hole assembly may be used to create the well path (e.g., the well path 14 or the well path 30) represented by the curve 108. At a given position 140 along the well path, the bottom hole assembly may utilize sensors (e.g., magnetometers disposed in a Direction & Inclination (D&I) module) to detect a direction of the bottom hole assembly with respect to the Earth magnetic field that is parallel to the axis 106. Based on the detected direction, the bottom hole assembly may determine certain drilling parameters, such as the azimuthal angle 120 and the inclination angle 130. The bottom hole assembly may utilize a rotary steerable system to adjust the drilling direction to maintain the well path to follow a planned well trajectory and reach to the position 110.

With the preceding in mind, FIG. 3 is schematic diagram of a tracked tool having a source emitting signal that may be detected by sensors of a tracking tool during the geological survey of FIG. 1. A tracked tool 200 is used to drill the well 10 with the well path 14. The tracked tool 200 includes a bottom hole assembly 206 (BHA1), which includes a rotary steerable system 208. The rotary steerable system 208 may be driven by a roll stabilizer to stabilize the bottom hole assembly 206 to avoid unintentional sidetracking and/or vibrations to maintain the quality of the well 10 being drilled.

The tracked tool 200 also includes a Direction & Inclination (D&I) module 212. The D&I module 212 may include an energy source 216 (e.g., a magnet) that may generate a magnetic field 218. The magnetic field 218 may transmit through the subsurface layers beneath the surface 20 and reach a tracking tool 220 used to drill the well 16 with the well path 30.

The tracking tool 220 includes a bottom hole assembly 226 (BHA2), which includes a rotary steerable system 228. The rotary steerable system 228 may be driven by a different roll stabilizer to stabilize the bottom hole assembly 226 to avoid unintentional sidetracking and/or vibrations to maintain the quality of the well 30 being drilled.

To improve a tracking accuracy of the bottom hole assembly 226 with respect to the bottom hole assembly 206, certain arrangements of an energy source and corresponding sensors may be employed to enable real-time data processing on both the bottom hole assembly 206 and the bottom hole assembly 226. For example, certain parameters, such as flight time (e.g., signal travel time) differences created by axial spacings of sensors, signal magnitude (e.g., amplitude) differences created by azimuthal positions of the sensors, and tool phases measured by the rotary steerable system 208 and the rotary steerable system 228, may be combined and processed to improve the tracking accuracy. Such additional parameters may provide an enhance relative position determination between the bottom hole assembly 206 and the bottom hole assembly 226.

Additionally, or alternatively, each of the bottom hole assembly 206 and the bottom hole assembly 226 may include an electromagnetic telemetry module allowing for direct communication between the two assemblies. Using the electromagnetic telemetry modules may enable automatic tracking without having time delays (e.g., caused by sending the data to a surface unit on the well 10 and downlinking action commands to the well 16).

With this in mind, the tracking tool 220 also includes a Direction & Inclination (D&I) module 232. The D&I module 232 may include multiple sensors (e.g., magnetometers 240, 242, and 244). The D&I module 232 may utilize the magnetometers 240, 242, and 244 to detect the magnetic field 218 emitted by the energy source 216 of the D&I module 212 in the tracked tool 200. Based on detected magnetic signals, the D&I module 232 may calculate certain drilling parameters (e.g., an azimuthal angle and an inclination angle) associated with the position, direction, and orientation of the tracking tool 220 with respect to the tracked tool 200. Based on the drilling parameters, the bottom hole assembly 226 may utilize rotary steerable system 228 to adjust certain operations (e.g., dynamically adjusting the drilling direction), thereby maintaining the well path 30 of the well 16 to follow the well path 14 of the well 10 during a simultaneous drilling process (e.g., simultaneous drilling of well paths 14 and 30). In this way, the well 16 is drilled with the well path 30 parallel to the well path 14 of the well 10 at a constant distance 260 (e.g., 50 to 70 meters). In certain embodiments, the well paths 14 and 30 may be parallel or substantially parallel, such as within a range of plus or minus 10 degrees from one another. Additionally, in certain embodiments, the well paths 14 and 30 may be separated by the constant or substantially constant distance 260, such as a target distance plus or minus 5, 10, or 15 percent of the target distance and/or the target distance plus or minus 5, 10, or 15 meters.

The magnetometers 240, 242, and 244 may be disposed in the D&I module 232 axially with respect to a central longitudinal axis 264 of the tracking tool 220. For example, the magnetometer 242 may be positioned at a distance 266 from the magnetometer 240 along the central longitudinal axis 264. The magnetometer 244 may be positioned at a distance 268 from the magnetometer 242 along the central longitudinal axis 264.

Additionally, the magnetometers 240, 242, and 244 may be disposed in the D&I module 232 azimuthally with respect to the central longitudinal axis 264 of the tracking tool 220 in a cross-section view 270 corresponding to a plane 272 perpendicular to the central longitudinal axis 264 of the tracking tool 220. For example, the magnetometers 240, 242, and 244 may be equally spaced (e.g., with a 120 degrees angle between each other) at a circumference 274 in the cross-section view 270.

With the magnetometers 240, 242, and 244 axially and azimuthally positioned in the D&I module 232 with respect to the central longitudinal axis 264 of the tracking tool 220, amplitudes of the signals generated from the magnetometers in response to detecting the magnetic field 218 may vary based on axial positions and azimuthal positions of the magnetometers 240, 242, and 244. The D&I module 232 may utilize the amplitudes of the signals from different magnetometers to determine the relative position between the tracked tool 200 and the tracking tool 220. Based on the relative position (e.g., including direction, orientation, and distance), the rotary steerable system 228 may cause the bottom hole assembly 226 to adjust the position and orientation to maintain the well path 30 of the well 16 to follow the well path 14 of the well 10 during the simultaneous drilling process.

For example, at a reference time 276 (e.g., at time t), the magnetometer 240 may detect the magnetic field 218 and generate a signal 278. Moreover, at a different time 280 (e.g., at time t+Δt1), the magnetometer 242 may detect the magnetic field 218 and generate a signal 282. Furthermore, at a different time 284 (e.g., at time t+Δt2), the magnetometer 244 may detect the magnetic field 218 and generate a signal 286.

As illustrated, the amplitudes of the signals 278, 282, and 286 are different due to the different axial positions and azimuthal positions of the magnetometers 240, 242, and 244 with respect to the central longitudinal axis 264 of the tracking tool 220, and the relative position of the tracking tool 220 with respect to the tracked tool 200. The different amplitudes of the signals 278, 282, and 286 may be utilized by the rotary steerable system 228 that may cause the bottom hole assembly 226 to drill the well 16 with the well path 30 that is parallel to the well path 14 of the well 10 at the constant distance 260 (e.g., 50 to 70 meters).

Although the D&I module 232 in present embodiment includes three sensors (e.g., magnetometers 240, 242, and 244), it should be understood that, in other embodiments, the D&I module 232 may include fewer (e.g., two) or more sensors (e.g., more than three sensors, such as 4, 5, 6, or more sensors). For example, the D&I module 232 may include two magnetometers disposed axially (e.g., with a distance) along the central longitudinal axis 264 of the tracking tool 220 and azimuthally (e.g., with a 180 degrees angle between each other) around the central longitudinal axis 264.

Although the energy source 216 in the present embodiment relates to a magnetic source, it should be understood that, in some embodiments, the D&I module 212 may include a different type of energy source. In one embodiment, the D&I module 212 may include an omnidirectional source generating a pulsing signal. For example, the pulsing signals may include electromagnetic pulses (e.g., generated by a bespoke antenna or by an electromagnetic telemetry module). In one embodiment, the pulsing signals may include seismic pulses, which may be generated by a seismic source (e.g., a seismic vibrator). In one embodiment, the pulsing signals may include sound or acoustic pulses, which may be generated by an acoustic source.

With the foregoing in mind, FIG. 4 is an example diagram of the tracked tool 200 and the tracking tool 220 of FIG. 3 having different components that may be used to determine relative positions between the tracked tool 200 and the tracking tool 220 during a geological survey. The tracked tool 200 used to drill the well 10 includes the rotary steerable system 208 that controls certain operations of a drilling bit 304 (e.g., adjusting rotations of drilling bit 304 to maintain the well path 14 to follow a planned well trajectory). A roll stabilized stabilizer 306 may be used to control the rotary steerable system 208. The roll stabilized stabilizer 306 includes a Direction and Inclination (D&I) module 308 to control the drilling direction and inclination of the well 10. The D&I module 308 may include multiple magnetometers (e.g., three magnetometers disposed at a 90 degree angle from each other).

In certain embodiments, the rotary steerable system 208 includes a permanent magnet 312. The permanent magnet 312 may be coupled to the drill bit 304 such that the permanent magnet 312 rotates with the drilling bit 304 on a plane perpendicular to an axis (e.g., a central longitudinal axis) of the tracked tool 200. In certain embodiments, the rotary steerable system 208 may include a different type of energy source, such as an electromagnetic source, a seismic source, and so on.

The tracking tool 220 used to drill the well 16 includes the rotary steerable system 228 that controls certain operations of a drilling bit 334 (e.g., adjusting rotations of drilling bit 334 to maintain the well path 30 to follow the well path 14 of the well 10). A roll stabilized stabilizer 336 may be used to control the rotary steerable system 228. The roll stabilized stabilizer 336 includes a Direction and Inclination (D&I) module 338 to control the drilling direction and inclination of the well 16. The D&I module 338 may include multiple sensors disposed in different locations and in different directions. In certain embodiments, the D&I module 338 may include three magnetometers disposed orthogonally (e.g., disposed at 90 degrees angel from each other. In certain embodiments, the D&I module 338 may include two or more different sensors (e.g., electromagnetic sensors, seismic sensors, sound or acoustic sensors, etc.) disposed axially and azimuthally with respect to a central longitudinal axis (e.g., axis 264) of the tracking tool 220.

During an operation of drilling the well 10, the D&I module 308 is roll stabilized. When a collar of the rotary steerable system 208 rotates, the permanent magnet 312 rotates together with the drilling bit 304, generating a rotating magnetic field. A low pass filter 350 may be used to filter out the rotating magnetic field such that the magnetometers disposed in the D&I module 308 may only detect a direct current (DC) magnetic field (e.g., the Earth magnetic field) representing a geological survey. Based on the detected direction and inclination with respect to the DC magnetic field, the rotary steerable system 208 may adjust drilling operations of the well 10 to maintain the well path 14 to follow a planned well trajectory.

During another operation of simultaneously drilling the well 16 with the well 10, the D&I module 338 is also roll stabilized. The D&I module 338 may be used to measure different magnetic fields. For example, similar to the D&I module 308 of the tracked tool 200, the D&I module 338 may measure a direct current (DC) magnetic field (e.g., the Earth magnetic field) representing the geological survey. The D&I module 338 may include a low pass filter 352 to filter out high frequency magnetic signals.

It should be noted that the components described above with regard to the tracked tool 200 and the tracking tool 220 are exemplary components and the tracked tool 200 and the tracking tool 220 may include additional or fewer components as shown. For example, each of the tracked tool 200 and the tracking tool 220 may include a mud telemetry module to transmit data (e.g., inclination data, azimuthal data).

Additionally, or alternatively, the D&I module 338 may measure an alternating current (AC) magnetic field (e.g., the rotating magnetic field generated by the rotating permanent magnet 312). The D&I module 338 may include a band pass filter 356 to filter out low frequency magnetic signals and only detect the rotating magnetic field. As mentioned previously, the amplitude of a detected signal (e.g., signal 278, 282, or 286 of FIG. 3) is proportional to a distance (e.g., distance 360) between the rotary steerable systems 208 and 228. The amplitude differences between signals measured by the D&I module 338 (e.g., using three magnetometers disposed orthogonally) may be used to by the rotary steerable system 228 to control the tracked tool 200 to drill the well 16 with the well path 30 that is parallel to the well path 14 of the well 10 at the constant distance 260 (e.g., 50 to 70 meters).

The technical effect of the disclosed embodiments is to provide two drilling tools (e.g., a tracked tool and a tracking tool each includes a bottom hole assembly) used to drill two geological wells (e.g., a tracked well and a tracking well) simultaneously such that a well path of the tracking well may track a well path of the tracked well during a geological (e.g., geothermal) survey. The tracked tool includes three or more sensors to measure a static magnetic field generated by the Earth. The tracked tool also includes a magnetic source (e.g., a permanent magnet) used to generate alternating magnetic signals. The tacking tool includes sensors or sensor arrays used to detect the alternating magnetic signals emitted from the magnetic source. Based on the detected signals, the tracking tool uses onboard processing circuitry to process the detected signals and determine a direction, an orientation, and a distance with respect to the tracked tool. Based on the determined relative direction, orientation, and distance, the tracking tool adjusts drilling operations using a rotary steerable system controlled by roll stabilized electronics, enabling the tracking tool to track the movement of the tracked tool in the real-time, resulting in the two wells being drilled simultaneously and parallelly with a constant distance between each other until both well paths intersect at a target position a reservoir.

The subject matter described in detail above may be defined by one or more clauses, as set forth below.

A system includes a second rotary steerable tool configured to control a second drilling bit to simultaneously drill a second well having a second well path that tracks a first well path of a first well being drilled by a first drilling bit controlled by a first rotary steerable tool. The first rotary steerable tool includes a first direction and inclination component including a first set of sensors configured to detect a static magnetic field and a permanent magnet coupled to the first drilling bit and configured to generate an alternating magnetic field. The second rotary steerable tool includes a second direction and inclination component including a second set of sensors configured to detect the alternating magnetic field.

The system of the preceding clause, wherein the first well and the second well are geothermal wells.

The system of any preceding clause, wherein the first well and the second well intersect at a target depth in a geothermal reservoir.

The system of any preceding clause, wherein each of the first well and the second well comprises a substantially vertical portion and a substantially horizontal portion, wherein the first well and the second well intersect at respective horizontal portion.

The system of any preceding clause, wherein each of the first rotary steerable tool and the second rotary steerable tool is controlled by a roll stabilizer.

The system of any preceding clause wherein the first calculated formation density is used to compensate the second calculated formation density to obtain a compensated formation density.

The system of any preceding clause, wherein the first rotary steerable tool is configured to steer and navigate the first drilling bit to drill the first well based on a planned well trajectory, and the second rotary steerable tool is configured to steer and navigate the second drilling bit to drill the second well based on the first well path.

The system of any preceding clause, wherein the first set of sensors comprises at least three magnetometers.

The system of any preceding clause, wherein the static magnetic field corresponds to an Earth magnetic field.

The system of any preceding clause, wherein the second set of sensors comprises at least two magnetometers.

The system of any preceding clause, wherein the at least two magnetometers are disposed axially along a central longitudinal axis of the first rotary steerable tool.

The system of any preceding clause, wherein the at least two magnetometers are equally disposed azimuthally along the central longitudinal axis of the first rotary steerable tool.

The system of any preceding clause, wherein the first rotary steerable tool comprises a low pass filter to filter out signals induced by the alternating magnetic field.

The system of any preceding clause, wherein the second rotary steerable tool comprises a band pass filter to filter out signals induced by the static magnetic field.

The system of any preceding clause, comprising at least two mud telemetry modules configured to transmit data between the first rotary steerable tool and the second rotary steerable tool.

A system includes a second rotary steerable tool configured to control a second drilling bit to simultaneously drill a second well having a second well path that tracks a first well path of a first well being drilled by a first drilling bit controlled by a first rotary steerable tool. The first rotary steerable tool includes a first direction and inclination component including a first set of sensors configured to detect a static magnetic field and a permanent magnet coupled to the first drilling bit and configured to generate an alternating magnetic field. The second rotary steerable tool includes a second direction and inclination component including a second set of sensors configured to detect the alternating magnetic field.

The system of the preceding clause, wherein the first and second well paths are substantially parallel and separated by a substantially constant distance.

The system of any preceding clause, wherein the first direction and inclination component comprises an omnidirectional source generating electromagnetic pulses.

A method that includes operating a first rotary steerable tool to control a first drilling bit to drill a first well having a first well path. The first rotary steerable tool includes a first direction and inclination component including a first set of sensors configured to detect a static magnetic field and a permanent magnet coupled to the first drilling bit and configured to generate an alternating magnetic field. The method also includes operating a second rotary steerable tool to control a second drilling bit to simultaneously drill a second well having a second well path that tracks the first well path. The second rotary steerable tool includes a second direction and inclination component including a second set of sensors configured to detect the alternating magnetic field.

The method of the preceding clause, wherein the first and second well paths are substantially parallel and separated by a substantially constant distance.

The method of any preceding clause, wherein the first direction and inclination component comprises a seismic source generating seismic pulses.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112 (f). However, for any claims containing elements designated in any other manner, it is intended that such elements are not to be interpreted under 35 U.S.C. § 112 (f).

The invention claimed is:

1. A system, comprising:

a first rotary steerable tool configured to control a first drilling bit to drill a first well having a first well path, wherein the first rotary steerable tool comprises:

a first direction and inclination component comprising a first set of sensors configured to detect a static magnetic field; and a signal source configured to generate a source signal; and a second rotary steerable tool configured to control a second drilling bit to simultaneously drill a second well having a second well path that tracks the first well path, wherein the second rotary steerable tool comprises a second direction and inclination component comprising a second set of sensors configured to detect the source signal, wherein sensors in the second set of sensors are spaced apart from one another at a plurality of axial positions, a plurality of azimuthal positions, or a combination thereof, wherein the second rotary steerable tool is configured to track the first rotary steerable tool at least based on differences in a signal travel time, a signal amplitude, or a combination thereof, of the source signal received at the second set of sensors.

2. The system of claim 1, wherein the signal source comprises a permanent magnet coupled to the first drilling bit and configured to generate the source signal.

3. The system of claim 1, wherein the first well and the second well are geothermal wells.

4. The system of claim 3, wherein each of the first well and the second well comprises a substantially vertical portion and a substantially horizontal portion, wherein the first well and the second well intersect at the respective substantially horizontal portions.

5. The system of claim 1, wherein the first well and the second well intersect at a target depth in a reservoir.

6. The system of claim 1, wherein each of the first rotary steerable tool and the second rotary steerable tool is controlled by a roll stabilizer, the first rotary steerable tool is configured to steer and navigate the first drilling bit to drill the first well based on a planned well trajectory, and the second rotary steerable tool is configured to steer and navigate the second drilling bit to drill the second well based on the first well path.

7. The system of claim 1, wherein sensors in the second set of sensors are spaced apart from one another at the plurality of azimuthal positions.

8. The system of claim 1, wherein the first set of sensors comprises at least three magnetometers, the static magnetic field corresponds to an Earth magnetic field, and the signal source comprises an electromagnetic source, a seismic source, or an acoustic source.

9. The system of claim 1, wherein the signal source is configured to generate the source signal as a pulsing signal.

10. The system of claim 1, wherein the second rotary steerable tool is configured to track the first rotary steerable tool at least based on differences in the signal travel time and the signal amplitude of the source signal received at the second set of sensors.

11. The system of claim 1, wherein sensors in the second set of sensors are spaced apart from one another at the plurality of axial positions and the plurality of azimuthal positions relative to a central longitudinal axis of the second rotary steerable tool.

12. The system of claim 11, wherein the second set of sensors comprises at least three sensors.

13. The system of claim 1, wherein the first rotary steerable tool comprises a low pass filter to filter out a portion of the source signal induced by an alternating magnetic field, and the second rotary steerable tool comprises a band pass filter to filter out a portion of the source signal induced by the static magnetic field.

14. The system of claim 1, comprising at least two mud telemetry modules configured to transmit data between the first rotary steerable tool and the second rotary steerable tool.

15. A system, comprising:

a second rotary steerable tool configured to control a second drilling bit to simultaneously drill a second well having a second well path that tracks a first well path of a first well being drilled by a first drilling bit controlled by a first rotary steerable tool;

wherein the first rotary steerable tool comprises a first direction and inclination component comprising a first set of sensors configured to detect a static magnetic field, and a signal source configured to generate a source signal; and wherein the second rotary steerable tool comprises a second direction and inclination component comprising a second set of sensors configured to detect the source signal, wherein sensors in the second set of sensors are spaced apart from one another at a plurality of axial positions, a plurality of azimuthal positions, or a combination thereof, wherein the second rotary steerable tool is configured to track the first rotary steerable tool at least based on differences in a signal travel time, a signal amplitude, or a combination thereof, of the source signal received at the second set of sensors.

16. The system of claim 15, wherein the second set of sensors comprises at least three sensors spaced apart from one another at the plurality of axial positions and the plurality of azimuthal positions.

17. The system of claim 15, wherein the first direction and inclination component comprises an omnidirectional source generating electromagnetic pulses.

18. A method, comprising:

operating a first rotary steerable tool to control a first drilling bit to drill a first well having a first well path, wherein the first rotary steerable tool comprises a first direction and inclination component comprising a first set of sensors configured to detect a static magnetic field, and a signal source configured to generate a source signal; and operating a second rotary steerable tool to control a second drilling bit to simultaneously drill a second well having a second well path that tracks the first well path, wherein the second rotary steerable tool comprises a second direction and inclination component comprising a second set of sensors configured to detect the source signal, wherein sensors in the second set of sensors are spaced apart from one another at a plurality of axial positions, a plurality of azimuthal positions, or a combination thereof, wherein the second rotary steerable tool is configured to track the first rotary steerable tool at least based on differences in a signal travel time, a signal amplitude, or a combination thereof, of the source signal received at the second set of sensors.

19. The method of claim 18, wherein the second set of sensors comprises at least three sensors spaced apart from one another at the plurality of axial positions and the plurality of azimuthal positions.

20. The method of claim 18, wherein the first and second well paths are substantially parallel and separated by a substantially constant distance, and the first direction and inclination component comprises a seismic source generating seismic pulses.

* * * * *